US009028675B2

(12) United States Patent
Bergeron et al.

(10) Patent No.: US 9,028,675 B2
(45) Date of Patent: May 12, 2015

(54) METHOD FOR INCREASING THERMAL STABILITY OF A FUEL COMPOSITION USING A SOLID PHOSPHORIC ACID CATALYST

(75) Inventors: Sebastien Bergeron, Bright's Grove (CA); Ashok Uppal, Sarnia (CA); Robert J. Falkiner, Brampton (CA); Marc-André Poirier, Sarnia (CA)

(73) Assignee: ExxonMobil Research and Engineering Company, Annandale, NJ (US)

( * ) Notice: Subject to any disclaimer, the term of this patent is extended or adjusted under 35 U.S.C. 154(b) by 380 days.

(21) Appl. No.: 13/535,436

(22) Filed: Jun. 28, 2012

(65) Prior Publication Data

US 2013/0068660 A1 Mar. 21, 2013

Related U.S. Application Data

(60) Provisional application No. 61/505,277, filed on Jul. 7, 2011.

(51) Int. Cl.

| | |
|---|---|
| ***C10G 17/00*** | (2006.01) |
| ***C10G 17/095*** | (2006.01) |
| ***C10G 53/10*** | (2006.01) |
| ***C10L 1/08*** | (2006.01) |
| ***C10G 61/02*** | (2006.01) |
| ***C10G 27/04*** | (2006.01) |
| ***C10G 29/04*** | (2006.01) |
| ***C10G 53/14*** | (2006.01) |

(52) U.S. Cl.

CPC ..... *C10G 17/095* (2013.01); *C10G 53/10* (2013.01); *C10L 1/08* (2013.01); *C10G 61/02* (2013.01); *C10G 27/04* (2013.01); *C10G 29/04* (2013.01); *C10G 53/14* (2013.01); *C10G 2300/202* (2013.01); *C10G 2300/301* (2013.01); *C10G 2400/08* (2013.01); *C10G 2300/4018* (2013.01); *C10G 2300/1051* (2013.01)

(58) Field of Classification Search

CPC ..... C10G 17/095; C10G 27/04; C10G 29/04; C10G 53/14; C10G 53/10; C10G 2300/1051; C10G 2300/4018; C10G 2400/08; C10G 2300/301; C10G 2300/202; C10G 61/02; C10L 1/08

USPC ..... 585/14; 208/88

See application file for complete search history.

(56) References Cited

U.S. PATENT DOCUMENTS

| | | | | |
|---|---|---|---|---|
| 2,267,458 | A | 12/1941 | Goldsby | |
| 2,853,432 | A | 9/1958 | Gleim et al. | |
| 3,051,648 | A | 8/1962 | Hess et al. | |
| 3,445,380 | A | 5/1969 | Urban | |
| 3,487,012 | A | 12/1969 | Plummer et al. | |
| 3,574,093 | A | 4/1971 | Strong | |
| 3,923,645 | A | 12/1975 | Anderson, Jr. et al. | |
| 4,098,681 | A | 7/1978 | Carlson | |
| 4,409,092 | A | 10/1983 | Johnson et al. | |
| 4,906,354 | A | 3/1990 | Barry et al. | |
| 4,912,873 | A | 4/1990 | Diaz et al. | |
| 4,946,815 | A * | 8/1990 | Chao et al. | 502/81 |
| 5,081,086 | A | 1/1992 | Wilcher et al. | |
| 6,313,323 | B1 | 11/2001 | Werner et al. | |
| 7,473,351 | B2 | 1/2009 | Burnett et al. | |
| 7,557,060 | B2 | 7/2009 | Xu et al. | |
| 8,063,260 | B2 * | 11/2011 | Xu et al. | 585/529 |
| 2003/0150153 | A1 | 8/2003 | Henry, Jr. et al. | |
| 2006/0194995 | A1 * | 8/2006 | Umansky et al. | 585/467 |
| 2009/0065434 | A1 * | 3/2009 | Zhang | 210/668 |
| 2011/0131870 | A1 | 6/2011 | Poirier et al. | |

FOREIGN PATENT DOCUMENTS

| | | | |
|---|---|---|---|
| EP | 1063276 | A1 | 12/2000 |
| JP | 1207389 | A | 8/1989 |
| WO | 03091361 | A2 | 11/2003 |
| WO | 2011/068663 | A1 | 6/2011 |

OTHER PUBLICATIONS

United States Statutory Invention Registration No. H1368 published on Nov. 1, 1994.

Tebogo M. Sakuneka et al.: Synthetic Fuel Production by Combined Propene Oligomerization and Aromatic Alkylation over Solid Phosphoric Acid, Industrial & Engineering Chemistry Research, vol. 47, No. 6, Mar. 1, 2008, pp. 1828-1834, ISSN: 0888-5885.

* cited by examiner

*Primary Examiner* — Randy Boyer
*Assistant Examiner* — Juan Valencia
(74) *Attorney, Agent, or Firm* — Chad A. Guice; Richard D. Jordan; Bruce M. Bordelon

(57) ABSTRACT

This invention relates to a method for increasing thermal stability of fuel, as well as in reducing nitrogen content and/or enhancing color quality of the fuel. According to the method, a fuel feedstock can be treated with a solid phosphoric acid catalyst under appropriate catalyst conditions, e.g., to increase the thermal stability of the fuel feedstock. Preferably, the fuel feedstock can be treated with the solid phosphoric acid catalyst at a ratio of catalyst mass within a contact zone to a mass flow rate of feedstock through the zone of at least about 18 minutes to increase the thermal stability of the fuel feedstock, along with reducing nitrogen content and/or enhancing color quality.

21 Claims, No Drawings

METHOD FOR INCREASING THERMAL STABILITY OF A FUEL COMPOSITION USING A SOLID PHOSPHORIC ACID CATALYST

CROSS-REFERENCE TO RELATED APPLICATION

This application claims priority to U.S. Provisional Application Ser. No. 61/505,277 filed Jul. 7, 2011, which is herein incorporated by reference in its entirety.

FIELD OF THE INVENTION

This invention relates to a method for increasing thermal stability of fuel. In particular, this invention relates to a method for increasing thermal stability of fuel, as well as in reducing nitrogen content and/or increasing color quality, in which a fuel feedstock is contacted or treated with a solid phosphoric acid catalyst to effectively increase the thermal stability of the fuel feedstock.

BACKGROUND OF THE INVENTION

The continued development of more powerful aviation turbine engines has demanded greater thermal stability of the fuel as a high temperature heat sink. This in turn requires better definition of the thermal stability of jet fuels, while still continuing to maintain high color quality. Thermal stability refers to the deposit-forming tendency of the fuel. Thus, it can be highly desirable that fuels for aviation turbine engines have sufficient thermal stability to prevent excessive deposits in the these powerful engines, as well as being relatively low in nitrogen content, while also exhibiting high color quality.

Although a number of refining techniques have improved thermal stability, most have drawbacks. For example, extraction methods with sulfuric acid, caustic, or $SO_2$ have waste disposal problems. Uses of absorption/adsorption methods with agents such as silica gel or alumina have had marginal success. Clay adsorption has reduced capacity/applicability for jet fuels derived from heavier crude sources, and generally requires large quantities of material.

U.S. Pat. No. 4,906,354 discloses a process by which the thermal stability of jet fuel sweetened by an oxidation process can be improved by washing the sweetened fuel with caustic. More specifically, the method the thermal stability of the jet fuel sweetened by oxidation, as measured by the JFTOT test, comprises washing the sweetened jet fuel with aqueous caustic, washing the caustic-extracted jet fuel with water, and drying the water-washed jet fuel.

Statutory U.S. Invention Registration No. H1368 describes a method for improving the long-term color stability of jet fuel and jet fuel blends containing nitrogen compounds by intimately mixing the jet fuel with a quantity of concentrated sulfuric acid sufficient to remove at least 90% of the nitrogen compounds during contact time equal or less than 5 minutes, separating the jet fuel from the concentrated sulfuric acid, mixing the jet fuel with an aqueous caustic solution to remove residual acid from the jet fuel, separating the jet fuel from the aqueous caustic solution, mixing the jet fuel with water, and separating the jet fuel from the water.

U.S. Pat. No. 4,912,873 relates to the treatment of diesel or jet fuel with a non-ionic, macroreticular, cross-linked, acrylic aliphatic ester resin such as XAD-7 that reduces polar impurities and diesel color. The diesel or jet fuel samples are analyzed by the "floc test" which measured the amount of floe visually observed on contact with an aqueous iron solution containing 5 mM ferric sulfate in 5 nM sulfuric acid.

U.S. Pat. No. 2,267,458 relates to a process for refining hydrocarbon oils containing objectionable sulfur, color, and gum-forming compounds. The process comprises subjecting the oil to treatment with used sulfuric acid, which has been obtained from the alkylation of isoparaffins with olefins in the presence of strong sulfuric acid, whereby such objectionable compounds are substantially removed.

U.S. Pat. No. 3,487,012 relates to a process for the improvement of initial color and long-term color stability of aromatic concentrates. The process is considered to improve both initial color and long-term color stability of aromatic concentrates boiling between 400 and 750° F. without substantially reducing the aromaticity. The process comprises hydrotreating, acid treating followed by caustic washing, and vacuum distilling aromatic concentrates at 5 to 250 mmHg absolute pressure with corresponding temperatures in the range from 150 to 650° F.

U.S. Pat. No. 4,409,092 is directed to a combination process for upgrading hydrocarbon fractions obtained from raw shale oil, oil products of coal processing and select fractions of crude oils comprising sulfur, nitrogen, and metal contaminants to produce jet fuel product fractions such as JP4, JP5, JP8 and other turbine-type fuel materials. The combination process involves hydrotreating, acid extraction of basic nitrogen compounds, and hydrofining. A catalytic cracking process is also used to convert high-boiling portions of the hydrocarbon feed fractions to product boiling in the desired jet fuel boiling range, before acid extraction of basic nitrogen compounds. Thus, the combination process is indicated as maximizing the yield of desired jet fuel products under hydrogenating conditions, particularly conserving the consumption of hydrogen.

PCT Publication No. WO 2003/091361 discloses a process for improving the thermal oxidative stability of a distillate fuel such as jet fuel. The thermal oxidative stability is improved by adsorbing N—H containing heterocyclic compounds, such as indoles and pyrroles, with an adsorbent material. The adsorbent material includes compounds having a benzaldehyde functionality supported on a suitable support. The preferred compound is 4-aminobenzaldehyde, with the preferred support being clay.

U.S. Pat. No. 7,473,351 discloses a process for reducing the nitrogen content of a liquid hydrocarbon feed such as diesel or jet fuel. The feed, which comprises an alkylating agent such as an olefin and an organic nitrogen species, is contacted with an acidic catalyst at elevated temperature in a first reaction zone to generate a liquid hydrocarbon product comprised of a reduced amount of the alkylating agent and an organic nitrogen species of higher boiling point. The alkylating agent and higher boiling point nitrogen species are separated out by fractionation. The acidic catalyst can be a liquid or solid catalyst, with solid acidic catalysts being preferred. Solid acidic materials may comprise acidic polymeric resins, supported acids and acidic inorganic oxides. There is no indication, however, that the catalysts can be used to treat the fuel in such a manner as to also exhibit high thermal stability and color quality.

U.S. Patent Application Publication No. 2011/0131870 discloses a process for increasing color quality and thermal stability of fuel. Fuel that is provided as a feedstock is contacted or treated with an acidic, ion-exchange resin to increase the color quality and stability of the fuel. The process provides the benefit of substantially increasing the long term quality of both color and oxidation (JFTOT) stability.

Additional methods for upgrading fuels, including enhancing color quality and stability of fuels, are needed. Additional reduction in nitrogen content can also be desired. These qualities can be particularly desirable in locations where hydroprocessing volume can be limited. In particular, more simple processes using more readily available materials as catalysts to assist in such processing are highly desired.

SUMMARY OF THE INVENTION

This invention provides a method resulting in fuels having a relatively high degree of thermal stability. The highly thermally stable fuels also exhibit improved color quality and/or can be relatively low in nitrogen content. In particular, the invention uses a solid phosphoric acid catalyst to treat fuel material and provide a fuel product that can have substantially improved thermal stability.

According to one aspect of the invention, there is provided a method for increasing thermal stability of fuel. The method includes a step of flowing a fuel feedstock through a contact zone containing solid phosphoric acid catalyst within the contact zone, the fuel feedstock preferably having an initial and final boiling point within a range from about 90° C. to about 360° C., e.g., from about 90° C. to about 300° C. The fuel feedstock can be treated with the solid phosphoric acid catalyst at a ratio of catalyst mass within the zone to a mass flow rate of feedstock through the zone of at least about 18 minutes to increase thermal stability of the fuel feedstock.

The solid phosphoric acid catalyst can be comprised of silicon orthophosphate. In one embodiment, the solid phosphoric acid catalyst can have a silicon orthophosphate to silicon pyrophosphate ratio of at least about 5:1. The solid phosphoric acid catalyst typically can have a pore volume of at least about 0.01 $cm^3$ per gram of catalyst and/or can have an average pore diameter of at least about 150 angstroms. The solid phosphoric acid catalyst should have an average particle size to provide relatively dense packing within the contact zone, such as, for example, not greater than about 1.5 mm.

The method can further include a step of treating the fuel feedstock with a caustic composition prior to contacting with the solid phosphoric acid catalyst. As an example, the fuel feedstock can be treated with a mercaptan oxidation catalyst prior to contacting with the solid phosphoric acid catalyst. Optionally, the fuel treated with the mercaptan oxidation catalyst can be water washed prior to contacting with the solid phosphoric acid catalyst.

In another optional step, the fuel feedstock can be treated with a caustic composition in the presence of a mercaptan oxidation catalyst to produce a mercaptan-reduced product, and the mercaptan-reduced product can be contacted with the solid phosphoric acid catalyst.

The method is particularly suitable for a fuel feedstock having an ASTM D86 10% boiling point in the range from about 110° C. to about 190° C. and/or an ASTM D86 90% boiling point in the range from about 200° C. to about 290° C. Such a fuel feedstock can include jet fuel.

Treatment of the fuel feedstock with the solid phosphoric acid can further increase color quality, for example by a differential color measurement of at least about 2. Treatment can further provide a treated fuel having a total nitrogen content of not greater than about 10 mg/l.

Treatment temperature can be within a range to minimize catalyst damage; for example, the fuel feedstock can be treated with the solid phosphoric acid catalyst at a temperature in a range from about 10° C. to about 100° C.

DETAILED DESCRIPTION OF THE INVENTION

This invention provides a method for increasing thermal stability of fuel, as well as for reducing nitrogen content and/or improving color quality. Although minimal treatment of a fuel feedstock with an acid catalyst can be effective to reduce nitrogen content of the fuel, enhance color quality, or both, treatment that affects nitrogen content and color quality may not necessarily affect thermal stability in the same positive manner. The method is particularly effective in that it can be carried out under appropriate catalyst treat conditions, using a solid phosphoric acid catalyst, such that the thermal stability of the fuel can be substantially enhanced, while optionally but preferably substantially enhancing long term color quality and/or significantly reducing nitrogen content.

Feedstock Fuel Composition

The fuel that is provided as feedstock or that can be treated according to this invention can be any one or more of kerosene, jet fuel, and diesel grades of fuel, including mixtures within or overlapping the particular boiling ranges of each indicated fuel. The invention is particularly suited to producing jet fuel grades of fuel. Boiling point ranges are preferably determined according to ASTM D86-09E1 Standard Test Method for Distillation of Petroleum Products at Atmospheric Pressure.

In one embodiment, the fuel/feedstock treated according to this invention can have initial and/or final boiling points (preferably both) within the range from about 90° C. to about 360° C. In preferred embodiments, the fuel/feedstock treated according to this invention can have both initial and final boiling points within the range from about 100° C. to about 340° C., for example from about 110° C. to about 320° C. or from about 120° C. to about 300° C.

In one embodiment, the method can be carried out by treating/contacting a feedstock fuel having an ASTM D86 10% distillation point (T10) within the range from about 110° C. to about 205° C., for example from about 110° C. to about 190° C., from about 115° C. to about 180° C. or from about 120° C. to about 160° C. Additionally or alternately, the method can be carried out by treating/contacting a feedstock fuel having an ASTM D86 90% distillation point (T90) within the range from about 200° C. to about 290° C., for example from about 210° C. to about 280° C. or from about 220° C. to about 270° C.

Solid Phosphoric Acid Catalyst

Solid phosphoric acid (SPA) catalysts can be prepared by combining a phosphoric acid with a support/carrier and drying the resulting material. In particular, the catalyst can be prepared by mixing the support with phosphoric acid, extruding the resulting paste, and calcining the extruded material. The activity of a solid phosphoric acid catalyst can be related to the amount and/or chemical composition of the phosphoric acid deposited on the support.

The phosphoric acid component of the SPA catalyst can, in some embodiments, be in more than one form. For example, the phosphoric acid component can be comprised of orthophosphoric acid ($H_3PO_4$), pyro-phosphoric acid ($H_4P_2O_7$), tri-phosphoric acid ($H_5P_3O_{10}$), tetra-phosphoric acid ($H_6P_4O_{13}$), or the like, or any combination thereof. The precise composition of a given sample of phosphoric acid can advantageously be a function of the $P_2O_5$ and water content of the sample. As the water content of the acid decreases, the degree of condensation of the acid can tend to increase. Each of the various phosphoric acids has a unique acid strength, and, accordingly, the catalytic activity of a given sample of solid phosphoric acid catalyst can depend on the $P_2O_5/H_2O$ ratio of the phosphoric acid deposited as/in/on the catalyst.

Support materials can include at least one metal selected from silicon, boron, aluminum, zirconium, titanium, and zinc, with supports comprising silicon being preferred.

In one embodiment, the solid phosphoric acid catalyst can be prepared by mixing together phosphoric acid, such as one or more of ortho-phosphoric acid, pyro-phosphoric acid, and tetra-phosphoric acid, with the solid carrier to form a wet paste. This paste can then be calcined and crushed (if necessary) to yield catalyst particles, or the paste may be extruded and/or pelletized prior to calcining to produce more uniform catalyst particles.

In a particular embodiment, the carrier can comprise or be a porous silicon-containing material, such as silica. Examples of such materials can include, but are not limited to, kieselguhr, kaolin, infusorial earth, diatomaceous earth, artificially prepared porous silica, and mixtures and/or reaction products thereof.

The catalyst can also optionally include one or more additives, particularly those tailored to increase catalyst strength and/or hardness. Examples of such additives can include, but are not limited to, mineral talc, fullers earth, iron compounds (including iron oxide), and the like, and mixtures or reaction products thereof.

The total amount of carrier and optional additive(s) in the SPA catalyst can vary relative to the phosphoric acid component. For example, the combination of the carrier and any additives that may be present can comprise from about 10 wt % to about 35 wt %, based on the weight of the total finished and/or calcined catalyst, e.g., from about 15 wt % to about 30 wt %. In many embodiments, the remainder of the SPA catalyst can be the phosphoric acid component, such that the SPA catalyst can be said to "consist essentially of" the phosphoric acid component, the carrier, and the optional additive(s).

In typical embodiments, pore volume should be adequate to allow or sufficient contact of the fuel with the internal portion of the catalyst, e.g., so as to enhance thermal stability of the fuel. In some preferred embodiments, the catalyst can have an average pore volume of at least about 0.01 $cm^3\ g^{-1}$, for example at least 0.02 $cm^3\ g^{-1}$.

Additionally or alternately, pore size should be sufficient to not significantly impede entry of fuel into/among the catalyst pores. In some preferred embodiments, the catalyst can have an average pore diameter of at least about 150 angstroms, for example at least about 200 angstroms.

Further additionally or alternately, the surface area of the catalyst should be sufficient to allow adequate contact with the fuel, and optionally but preferably not to unduly extend residence time in the contactor. In some preferred embodiments, the SPA catalyst can have an average specific surface area of at least about 1 $m^2/g$, for example at least about 5 $m^2/g$. Surface area can be determined according to ASTM D3663-03 (2008), Standard Test Method for Surface Area of Catalysts and Catalyst Carriers.

In one embodiment, the catalyst can be comprised of a silicon orthophosphate component and optionally also a silicon pyrophosphate component. In such embodiments, the catalyst can advantageously exhibit an integrated X-ray diffraction (XRD) reflectance peak intensity ratio of silicon orthophosphate to silicon pyrophosphate of at least about 4:1, preferably at least about 5:1, for example at least about 6:1 or at least about 8:1. Without being bound by theory, the XRD reflectance intensity may be determined using the (113) planes of silicon orthophosphate and the (002) planes of silicon pyrophosphate. It is understood that in cases where no crystalline silicon pyrophosphate is detected using XRD techniques, the ratio is represented as 1:0.

In additional or alternate embodiments, the solid phosphoric acid catalyst used according to the invention can exhibit a silicon phosphate crystallinity of at least 25%, for example at least 30% or at least 40%, relative to an alpha-alumina standard. The catalyst can additionally or alternately be comprised of pyrophosphate crystallites, preferably with at least 0.1% crystallinity (as measured by X-ray diffraction) relative to alpha-alumina.

The crystallinity type and total/relative crystallinity of the finished solid phosphoric acid catalyst can preferably be determined using X-ray diffraction techniques and employing a National Bureau of Standards alpha-alumina reference material. This analysis can provide relative values of silicon orthophosphate and optionally also silicon pyrophosphate both with respect to alpha-alumina, not necessarily relative to each other and not necessarily indicating absolute values of crystallinity.

To determine the relative crystallinity of a finished solid phosphoric acid catalyst sample, the sample can first be ground to fine powder (about −325 mesh). The sample can then be inserted into an X-ray diffractometer preferably equipped with a copper anode X-ray tube, at which point a quantitative diffraction scan can be acquired. Raw integrated intensities of silicon phosphate phases can be acquired, e.g., by integrating the (002) peak of silicon pyrophosphate and the (113) peak of silicon orthophosphate. These raw integrated intensities can be compared to that of an alpha-alumina external standard by integrating the (012), (104), and (113) peaks on a similar preparation. Relative X-ray intensities of silicon phosphate phases can be obtained by dividing their respective raw integrated intensities by the sum of raw integrated intensities of three peaks of an alpha-alumina external standard. The result can be (multiplied by 100 and) expressed in terms of percent crystallinity units.

Total crystallinity, as used herein, can advantageously be relative to an external standard, instead of absolute (relative to an internal standard). The total crystallinity of the solid phosphoric acid catalyst can thus represent the sum of the silicon orthophosphate crystallinity (X-ray diffraction) peaks relative to alpha-alumina, and silicon pyrophosphate crystallinity (X-ray diffraction) peaks relative to alpha-alumina. The relative intensity ratio refers to the ratio of the integrated area under the silicon orthophosphate crystalline (X-ray diffraction) peaks (optionally relative to alpha-alumina) divided by the integrated area under the silicon pyrophosphate crystalline (X-ray diffraction) peaks (optionally relative to alpha-alumina).

The solid phosphoric acid catalyst can be manufactured according to any suitable method and provided in any number of suitable shapes or forms. Such examples are described in greater detail, e.g., in U.S. Pat. Nos. 7,557,060, 4,946,815, 5,081,086, and 6,313,323, the disclosures of which are each incorporated by reference. One example manufacturing method can be extrusion. Extrusion can allow the catalyst to be manufactured in various shapes having the desired pore diameter and/or pore volume distribution.

The solid phosphoric acid catalysts that can be used according to this invention can be prepared by mixing the desired phosphoric acid with the desired solid carrier. Mixing can be carried out at any appropriate temperature, for example, from about 10° C. to about 230° C., preferably between about 35° C. and about 100° C. The mixture can typically be referred to as "green" material, which can be a "dough" or "paste" type material. The dough can have a slightly moist to almost dry appearance, but may be extruded in a hydraulic press-type and/or auger-type extruder and/or a gear-type pelletizer, and then cut into shaped particles.

Other ingredients, including without limitation additional water, modifiers, binders, cements, and/or organic material, can be added to the green paste. In one embodiment, a material that produces gas during calcination can be used to aid in the formation of pores. Materials that produce gas during calcination can include water or other organic volatiles that can produce gas by evaporation and/or by loss on ignition. Specific examples of such materials can include, but are not limited to, starch, cellulose, nitrates, carbonates, oxalates, acetates and/or other organic salts, polymers, and the like, as well as compounds containing coordinated water and/or ammonia that can produce gas by decomposition and/or combustion.

In an embodiment, "green" paste can be formed by mixing a phosphoric acid with a silicon based carrier. The green paste can then be calcined, which includes sufficient heating to harden and/or crystallize at least a portion of the paste. Calcination temperatures and times should be sufficient to adequately grow crystalline phases of the resulting phosphate and carrier complex. Examples of such complexes can include, without limitation, silicon orthophosphate and silicon pyrophosphate.

As one example, the paste can be calcined in one or more stages, with each stage of a multi-stage process having its own time, temperature, oxygen level, and moisture level, inter alia. For example, extrudates can be formed and then calcined at a temperature from about 200° C. to about 800° C., such as from about 300° C. to about 600° C. The calcined material can optionally be steamed at a temperature from about 100° C. to about 300° C. Calcination times can vary with conditions (such as temperature and oxygen level), but can typically range from about 20 minutes to 4 hours in many embodiments.

The catalyst can be prepared or crushed to achieve an average overall particle size as desired. In an embodiment, the average overall particle size of the calcined catalyst can be from about 0.1 mm to about 2 mm, for example from about 0.2 mm to about 1.5 mm.

Temperature

The method according to the invention can typically be carried out at a temperature at which the catalyst can significantly affect thermal stability of the feedstock being treated. Preferably, the method can be carried out at a temperature of at least about 10° C., for example from about 10° C. to about 100° C. or from about 15° C. to about 80° C.

In general, the upper temperature limit can primarily depend on the temperature-resistance of the catalyst used. Thus, in some embodiments, it can be preferred that the temperature be about 80° C. or less. Additionally or alternately, the temperature can range from about 15° C. to about 50° C.

Pressure

The pressure at which the feedstock or provided fuel is contacted with the catalyst can generally be considered relatively low pressure. In particular, the method can be carried out at an average pressure from about 1 atm to about 10 atm (about 100 kPaa to about 1.0 MPaa), for example from about 1 atm to about 5 atm (about 100 kPaa to about 500 MPaa).

Treatment to Enhance Thermal Stability

The feedstock/fuel can be treated with the solid phosphoric acid catalyst in a manner effective for enhancing the thermal stability of the fuel. Although minimal treatment with the catalyst can be effective to reduce nitrogen content of the fuel and/or enhance color quality, treatment that affects nitrogen content and color quality may not necessarily affect thermal stability in the same positive manner.

In order to ensure effective thermal stability of the treated fuel, the fuel can be treated with the catalyst in a vessel, e.g., having a fixed bed of catalyst, at a sufficient treat rate and/or catalyst contact time. Otherwise, it is possible that nitrogen content and/or color quality of the fuel can be affected with little to no impact on thermal stability improvement.

The method can be carried out as a batch process or in a continuous process. In one embodiment, fuel feedstock can be treated with the solid phosphoric acid catalyst at a ratio of at least about 0.04 grams of catalyst per 45 ml of the feedstock, for example at least about 0.06 grams of catalyst per 45 ml of the feedstock.

At conditions in which feedstock is flowed through a vessel, the feedstock can flow at a rate allowing sufficient contact time of the feedstock with the catalyst in order to (positively) significantly affect thermal stability of the treated product. The flow rate can be any desirable rate, as long as sufficient contact with sufficient quantity of catalyst is ensured. In one embodiment, contact between catalyst and flowing feedstock can be carried out in a contact zone at a ratio of catalyst mass within the zone to a mass flow rate of feedstock through the zone of at least about 18 minutes, for example at least about 20 minutes or at least about 22 minutes.

In one embodiment, the feed can flow though the contact zone at an average liquid hourly space velocity (LHSV) from about 0.1 $hr^{-1}$ to about 10 $hr^{-1}$, for example from about 0.1 $hr^{-1}$ to about 5 $hr^{-1}$.

Fuel thermal stability is determined in this invention according to JFTOT, i.e., ASTM D3241-09 Standard Test Method for Thermal Oxidation Stability of Aviation Turbine Fuels (also known as JFTOT Procedure). JFTOT test results, which are pressure-based test results, can be indicative of fuel performance during gas turbine operation and can be used to assess the level of deposits that can form when liquid fuel contacts a heated surface at a specified temperature. The greater the pressure drop according to the JFTOT Procedure, the poorer stability of the fuel. A "pass" according to this JFTOT test can be defined by tube deposit, which can preferably be less than 3, combined with a differential pressure drop over the required 3-hour test period of not greater than 25 mm Hg.

in one embodiment, the method of this invention can increase stability by reducing pressure drop in treated fuel by at least 10%, relative to the fuel prior to treatment and according to ASTM D3241-09, e.g., by at least 20% or by at least 30%.

Fuels that have relatively high pressure drops and/or a significant tube deposit rating according to the JFTOT Procedure can be ideal candidates for treatment using the methods according to the invention. Thus, in some embodiments, the fuel provided for treatment can have an initial pressure drop of at least about 15 mm Hg according to ASTM D3241-09, e.g., that can have an untreated pressure drop of at least about 20 mm Hg, or at least about 25 mm Hg, according to ASTM D3241-09.

JFTOT pressure drop of the product produced according to the invention generally meets a wide variety of fuel specifications. In one embodiment, the provided fuel can be contacted/treated with the solid phosphoric acid catalyst to produce a fuel product having a pressure drop of about 15 mm fig or less, for example about 12 mm Hg or less or about 10 mm Hg or less, according to ASTM D3241-09.

For example, in an embodiment, the fuel feedstock has a pressure drop of at least 20 mmHg per ASTM D3241-09 and the fuel product has a pressure drop less than 12 mmHg. In yet another embodiment, the fuel feedstock has a pressure drop of at least 25 mmHg per A S™ D3241-09 and the fuel product has a pressure drop less than 12 mmHg.

Color Quality

Color quality of certain fuels can be considered an important quality in that, in certain cases, color of the fuel can indicate the degree of the refinement of the fuel. For example, when color is outside of a standard/established range, this can indicate possible product contamination. According to this invention, color quality can be determined using ASTM D156-07a, Standard Test Method for Saybolt Color of Petroleum Products (Saybolt Chromometer Method), but can alternately be measured by spectrophotometry to provide a qualitative color quality comparison.

In methods according to this invention, the color quality of the fuel material being treated can be increased by at least 10%, for example by at least 20% or by at least 30%.

The method can be advantageously effective in treating fuel type materials that initially have a color quality below fuel use specification. In such embodiments, an off-spec (color) fuel material can be contacted with the solid phosphoric acid catalyst, wherein the off-spec fuel can have an initial color quality of about 20 or less, for example about 19 or less, about 18 or less, about 17 or less, about 16 or less, about 15 or less, about 14 or less, about 13 or less, or about 12 or less.

The fuel treated according to this invention can preferably be contacted/treated with the solid phosphoric acid catalyst to provide a fuel having a color quality of at least about 20, for example at least about 22, at least about 24, at least about 26, or at least about 27.

For example, in an embodiment, the fuel feedstock has a color quality measurement of at least about 22 and the fuel product has a color quality measurement of about 18 or less according to ASTM D156-07a. In yet another embodiment, the fuel feedstock has a color quality measurement of at least about 24 and the fuel product has a color quality measurement of about 16 or less according to ASTM D156-07a.

Increase in color quality can be indicated by an improvement in color of the treated fuel, compared to the untreated fuel. In an embodiment, the color quality is increased following contact with the solid phosphoric acid catalyst by a differential color measurement of (e.g., the improvement in the color quality upon treatment can be) at least about 2, for example at least about 4 or at least about 6.

Nitrogen Removal

Nitrogen content of feedstock fuel can be substantially reduced according to this invention. Nitrogen content can be determined according to ASTM D4629, Standard Test Method for Trace Nitrogen in Liquid Petroleum Hydrocarbons by Syringe/Inlet Oxidative Combustion and Chemiluminescence Detection.

In many embodiments, total nitrogen content of the feedstock/fuel material can be decreased by at least about 10%, for example by at least about 20% or by at least about 30%, by using the methods according to the invention.

The methods can be effective to treat fuel type materials that initially have total nitrogen content above fuel use specification, or, for fuels such as jet fuel that do not have a nitrogen specification, merely higher than desired. For instance, the method can include contacting/treating a fuel material with the solid phosphoric acid catalyst, wherein the fuel to be treated can have an initial total nitrogen content of greater than gm/l, for example at least about 11 mg/l, at least about 12 mg/l, or at least about 15 mg/l.

As a result, in various embodiments, the fuel treated according to this invention can be contacted/treated with the solid phosphoric acid catalyst under conditions sufficient to provide a fuel having a total nitrogen content of not greater than mg/l, for example about 8 mg/l or less, about 6 mg/l or less, or about 4 mg/l or less.

For example, in an embodiment, the fuel feedstock has a total nitrogen content of at least about 12 mg/l and the fuel product has a total nitrogen content of about 10 mg/l or less. In yet another embodiment, the fuel feedstock has a total nitrogen content of at least about 15 mg/l and the fuel product has a total nitrogen content of about 8 mg/l or less.

Mercaptan Removal

In one embodiment of the invention, the provided fuel/feedstock to be treated can be contacted/treated to reduce and/or remove mercaptan content. In a particular embodiment, the mercaptan content can be reduced and/or removed by converting at least a portion of the mercaptan, e.g., to disulfides. An example of this type of conversion can be by treating with a caustic in the presence of a mercaptan oxidation catalyst, e.g., using a Merox™ process.

In a particular embodiment of the invention, produced/provided fuel having color quality and stability below a predetermined or set level can be contacted/treated with an alkaline (caustic) composition in the presence of a mercaptan oxidation catalyst to reduce the level or mercaptans in a mercaptan-reduced product. The mercaptan-reduced product can be further contacted/treated with the solid phosphoric acid catalyst to increase the color quality and stability of the mercaptan-reduced product to form a fuel of increased and/or predetermined color quality and stability.

A particular embodiment of the subject invention can be described as a method for treating hydrocarbons, which comprises the steps of passing an oxygen-containing gas (e.g., air), an aqueous alkaline composition, and a feed stream that contains mercaptans and a hydrocarbon fuel type composition into an oxidation zone to form a product reduced in mercaptans. In this embodiment, a substantial portion of the mercaptans in the hydrocarbon can be converted to disulfides. The mercaptan-reduced hydrocarbon can be contacted/treated with the solid phosphoric acid catalyst to produce a fuel product having enhanced color quality and stability.

In some embodiments, the product from the oxidation zone can be sent to a separation unit where at least a portion of the aqueous alkaline composition can be separated from the hydrocarbon component, which can advantageously be reduced in mercaptan content. This mercaptan-reduced hydrocarbon can be further contacted/treated with the solid phosphoric acid catalyst. Optionally but preferably, the mercaptan-reduced hydrocarbon or fuel can be water washed prior to contact/treatment with the solid phosphoric acid catalyst. When water washing is performed, it can be advantageous to dry the mercaptan-reduced hydrocarbon or fuel, e.g., using a salt, to remove excess water.

A mercaptan oxidation catalyst can preferably be employed in the oxidation zone. This catalyst can be supported on a bed of (relatively) inert solids retained within the oxidation zone, and/or it can be dispersed or dissolved in the aqueous alkaline solution. Any suitable mercaptan oxidation catalyst can be employed. One example is described in U.S. Pat. No. 3,923,645, the contents of which are hereby incorporated by reference herein, where a catalyst comprising a metal compound of tetrapyridinoporphyrazine is retained on an inert granular support. Other examples of such a catalyst can include a metallic phthalocyanine, such as described in U.S. Pat. Nos. 2,853,432, 3,445,380, 3,574,093, and 4,098,681, the contents of each of which are hereby incorporated by reference herein. The metal of the metallic phthalocyanine can include or be titanium, zinc, iron, and/or manganese, but can preferably include or be cobalt and/or vanadium. The metal phthalocyanine can additionally or alternately be employed in the form a derivative compound, specific examples of which can include, but are not limited to, cobalt phthalocyanine monosulfonate and cobalt phthalocyanine disulfonate.

When the mercaptan oxidation catalyst is used in its supported form, an absorbent carrier material that is preferably relatively inert can be employed. This carrier material can be in the form of tablets extrudates, spheres, or randomly shaped naturally occurring pieces. Natural materials, such as clays, silicates, and/or refractory inorganic oxides, can be used as the support material. Additionally or alternately, the support can be formed from diatomaceous earth, kieselguhr, kaolin, alumina, and/or zirconia.

The active mercaptan oxidation catalytic material can be added to the support in any suitable manner, e.g., by impregnation by dipping, followed by drying. In some cases, the catalyst may be formed in situ within the oxidation zone. In certain embodiments, the finished catalyst can contain from about 0.1 wt % to about 10 wt % of a metal phthalocyanine, based on total weight of the finished catalyst.

In one particular embodiment of the invention, an aqueous alkaline solution can be admixed with the hydrocarbon stream containing the mercaptan, and an oxygen-containing gas (e.g., air) and the mixture can be passed through a fixed bed of the oxidation catalyst. A preferred alkaline solution can comprise an alkali and/or alkaline earth metal hydroxide, such as sodium hydroxide (generally referred to as caustic), potassium hydroxide, and/or calcium hydroxide. When sodium hydroxide is used, it can preferably have a concentration from about 1 wt % to about 40 wt % in solution, for example from about 1 wt % to about 25 wt %. Any other suitable alkaline material can be employed if desired.

The rate of addition of oxygen-containing gas can be tailored to the mercaptan content of the hydrocarbon feed stream to the oxidation zone. The rate of oxygen addition can advantageously be greater than the amount required to oxidize all of the mercaptans contained in the feed stream, with oxygen (equivalent) feed rates from about 110% to about 220% of the stoichiometric need being preferred in some embodiments.

The use of a packed bed contacting zone can be preferred in the oxidation zone in certain embodiments. Perforated plates, channeled mixers, inert packing, and/or fibers can additionally or alternately be used to provide turbulence. Contact times in the oxidation zone can generally be chosen to be equivalent to an LHSV based on hydrocarbon charge of about 1 $hr^{-1}$ to about 70 $hr^{-1}$. The oxidation zone can generally be maintained at a temperature of at least about 50° F. (about 10° C.), and typically not greater than about 300° F. (about 149° C.). The pressure in the contacting zone can generally be above atmospheric pressure, for example greater than about 50 psig (about 350 kPag).

Alternative/Additional Embodiments

Additionally or alternately, the invention can include one or more of the following embodiments.

Embodiment 1. A method for increasing thermal stability of fuel, comprising:

flowing a fuel feedstock through a contact zone containing solid phosphoric acid catalyst within the contact zone, wherein the fuel feedstock has an initial and final boiling point within a range from about 90° C. to about 360° C. (194° F. to about 680° F.), and wherein the fuel feedstock is in contact with the solid phosphoric acid catalyst for a period of time of at least about 18 minutes; and producing a fuel product that has a higher thermal stability than the fuel feedstock according to ASTM D3241-09.

Embodiment 2. The method of embodiment 1, wherein the solid phosphoric acid catalyst is comprised of silicon orthophosphate.

Embodiment 3. The method of embodiment 2, wherein the solid phosphoric acid catalyst is further comprised of silicon pyrophosphate and exhibits an integrated X-ray diffraction (XRD) reflectance peak intensity ratio of silicon orthophosphate to silicon pyrophosphate of at least about 4:1.

Embodiment 4. The method of any of embodiments 2-3, wherein the solid phosphoric acid catalyst has a silicon phosphate crystallinity of at least 25% relative to an alpha-alumina standard.

Embodiment 5. The method of any prior embodiment, wherein the solid phosphoric acid catalyst is comprised of pyrophosphate crystallites with at least 0.1% crystallinity (as measured by X-ray diffraction) relative to alpha-alumina.

Embodiment 6. The method of any prior embodiment, wherein the solid phosphoric acid catalyst has a pore volume of at least about 0.01 $cm^3$ per gram of catalyst.

Embodiment 7. The method of any prior embodiment, wherein the solid phosphoric acid catalyst has an average pore diameter of at least about 150 angstroms.

Embodiment 8. The method of any prior embodiment, wherein the solid phosphoric acid catalyst has an average particle size of not greater than about 1.5 mm.

Embodiment 9. The method of any prior embodiment, wherein the fuel feedstock is treated with a caustic composition prior to contacting with the solid phosphoric acid catalyst.

Embodiment 10. The method of any prior embodiment, wherein the fuel feedstock is treated with a mercaptan oxidation catalyst prior to contacting with the solid phosphoric acid catalyst.

Embodiment 11. The method of embodiment 10, wherein the fuel feedstock that is treated with the mercaptan oxidation catalyst is water washed prior to contacting with the solid phosphoric acid catalyst.

Embodiment 12. The method of any of embodiments 1-8, wherein the fuel feedstock is treated with a caustic composition in the presence of a mercaptan oxidation catalyst to produce a mercaptan-reduced product, and the mercaptan-reduced product is contacted with the solid phosphoric acid catalyst.

Embodiment 13. The method of any prior embodiment, wherein the fuel feedstock is jet fuel.

Embodiment 14. The method of any prior embodiment, wherein the fuel feedstock has an ASTM D86 10% boiling point in a range from about 110° C. to 190° C. (230° F. to 374° F.), and an ASTM D86 90% boiling point in a range from about 200° C. to about 290° C. (392° F. to 554° F.).

Embodiment 15. The method of any prior embodiment, wherein the fuel feedstock has an pressure drop of at least 20 mmHg per ASTM D3241-09 and the fuel product has an pressure drop less than 12 mmHg.

Embodiment 16. The method of any prior embodiment, wherein the fuel product has an increase in color quality by a differential color measurement of at least about 2 according to ASTM D156-07a relative to the fuel feedstock.

Embodiment 17. The method of any prior embodiment, wherein the fuel feedstock has a color quality measurement of at least about 22 and the fuel product has a color quality measurement of about 18 or less according to ASTM D156-07a.

Embodiment 18. The method of any prior embodiment, wherein the fuel product has a total nitrogen content of at least about 10% less than the total nitrogen content of the fuel feedstock.

Embodiment 19. The method of any prior embodiment, wherein the fuel feedstock has a total nitrogen content of at least about 12 mg/l and the fuel product has a total nitrogen content of about 10 mg/l or less.

Embodiment 20.

The method of any prior embodiment, wherein the fuel feedstock is treated with the solid phosphoric acid catalyst within the contact zone at a temperature in a range from about 10° C. to about 100° C. (50° F. to 212° F.).

Embodiment 21. The method of any prior embodiment, wherein the fuel feedstock is treated with the solid phosphoric acid catalyst within the contact zone at a pressure from about 1 atm to about 10 atm (about 100 kPaa to about 1.0 MPaa).

Embodiment 22. The method of any prior embodiment, wherein the liquid hourly space velocity (LHSV) of the fuel feedstock through the solid phosphoric acid catalyst in the contact zone is about 0.1 hr to about 10 $hr^{-1}$.

EXAMPLES

The present invention is illustrated in greater detail by the specific examples presented below. It is understood that these examples are to be considered as specific examples or preferred embodiments of the overall aspect of the invention as claimed, and the invention is not to be limited to only the embodiments of the invention described in the Examples.

Example 1

The feed used was a jet fuel cut produced from a crude slate with about 70% heavy Canadian crude. The jet fuel cut or fraction was treated with a ~0.1 N solution of NaOH and air to simulate color degradation that typically occurs during a Merox™-type process, followed by 3 water washes to remove residual caustic and 2 filtrations to remove excess water using an ~11 micron cellulose filter from Whatman. As a reference, the color rating tends to increase as the color bodies are removed from the jet fuel.

Table 1 below shows the properties of the jet fuel used as the feed.

TABLE 1

| Jet fuel fraction from ~70% heavy Canadian crude, caustic and air treated | |
|---|---|
| Density (kg/l) | ~0.825 |
| Sulfur (wppm) | ~2900 |
| Nitrogen (mg/l) | ~11 |
| Color (Saybolt—ASTM D156) | +6 |
| Color (Spectrophotometer—LICO 400) | +7 |

Example 2

Table 2 shows the effect of treating the feed with either PolyMax® 845 or PolyMax® 131 using different treat levels. Both catalysts were crushed beforehand and sieved such that only sizes smaller than −0.42 mm were used. The jet fuel and the catalyst were in contact for about 24 hours in a shaker under an inert (nitrogen gas) atmosphere at room temperature (about 20° C. to about 25° C.). As the amount of catalyst treatment increased, the nitrogen concentration decreased and the color improved. The color was measured and is shown in Table 2 as color improvement, which means the difference between the treated fuel color and the initial fuel color. It can be seen from Table 2 that at even at low levels of treatment of fuel with solid phosphoric acid catalysts (i.e., ~0.02 g/45 ml) a substantial increase in color quality and a substantial reduction in overall nitrogen content resulted.

TABLE 2

| | PolyMax ® 845 | | | PolyMax ® 131 | | |
|---|---|---|---|---|---|---|
| Treat (g per 45 ml) | 0 | 0.02 | 0.04 | 0 | 0.02 | 0.04 |
| Nitrogen (mg/l) | 10.7 | 3.2 | 1.1 | 10.7 | 3.9 | 1.3 |
| Color improvement upon treatment (by spectrophotometer—LICO 400) | +0 | +11 | +15 | +0 | +11 | +15 |

Example 3

Table 3 highlights the effect of temperature on the effectiveness of treatments involving PolyMax® 845. All other operating conditions, including the solid phosphoric acid particle size, contact time, and (inert) atmosphere remained the same as in Example 2. Although treatments at both ~25° C. and ~60° C. showed substantial benefits, Table 3 suggests that treatment at the lower temperature can result in slightly more observable color and nitrogen improvements.

TABLE 3

| | ~25° C. | | | ~60° C. | | |
|---|---|---|---|---|---|---|
| Treat (g per 45 ml) | 0 | 0.02 | 0.04 | 0 | 0.02 | 0.04 |
| Nitrogen (mg/l) | 10.7 | 3.2 | 1.1 | 10.6 | 4.3 | 1.6 |
| Color improvement upon treatment (by spectrophotometer—LICO 400) | +0 | +11 | +15 | +0 | +6 | +10 |

Example 4

Table 4 below shows the effect of water content in the feed using PolyMax® 845 at about 60° C. Distilled water was injected in the feed at room temperature (about 20° C. to about 25° C.), resulting in a water concentration of about 100 wppm, compared with approximately 50 wppm before injection. Again, all other operating conditions, including the catalyst particle size, contact time, and (inert) atmosphere remained the same as in Example 2. Increasing the concentration of water appeared to have a negligible effect (very little impact, if any) on both the color and the nitrogen removal.

TABLE 4

| | ~50 wppm $H_2O$ | | | ~100 wppm $H_2O$ | | |
|---|---|---|---|---|---|---|
| Treat (g per 45 ml) | 0 | 0.02 | 0.04 | 0 | 0.02 | 0.04 |
| Nitrogen (mg/l) | 10.6 | 4.3 | 1.6 | 10.1 | 3.9 | 1.4 |
| Color improvement upon treatment (by spectrophotometer—LICO 400) | +0 | +6 | +10 | +0 | +5 | +10 |

Example 5

Table 5 highlights the effect of catalyst particle size using PolyMax® 845 at room temperature (about 20° C. to about 25° C.). The contact time was again about 24 hours in a shaker under an inert (nitrogen gas) atmosphere. No water was added to the feed. In one case, only catalyst particle sizes smaller than ~0.84 mm were used, whereas, in the second case, only catalyst particle sizes smaller than ~0.42 mm were used. Reducing the maximum (and average) catalyst particle size resulted in a slightly increased nitrogen removal (slightly lower nitrogen content) but had a negligible effect (very little impact, if any) on the color.

TABLE 5

| | Sizes < 0.84 mm | | | Sizes < 0.42 mm | | |
|---|---|---|---|---|---|---|
| Treat (g per 45 ml) | 0 | 0.02 | 0.04 | 0 | 0.02 | 0.04 |
| Nitrogen (mg/l) | 10.7 | 3.9 | 1.4 | 10.7 | 3.2 | 1.1 |
| Color improvement upon treatment (by spectrophotometer—LICO 400) | +0 | +11 | +14 | +0 | +11 | +15 |

Example 6

Table 6 below shows the effect on the thermal stability of the jet fuel once treated with PolyMax® 845. Again, the treated jet fuel was in contact with the solid phosphoric acid for about 24 hours in a shaker under an inert (nitrogen gas) atmosphere at room temperature (about 20° C. to about 25° C.). Catalyst particle sizes of less than ~0.42 mm were used. It can be seen that an increase in both color rating and thermal stability, as well as a JFTOT pass, was obtained upon treatment.

TABLE 6

| Treat (g per 45 ml) | Untreated jet 0 | Treated jet 0.05 |
|---|---|---|
| Nitrogen (mg/l) | 10.7 | 1.0 |
| Color improvement upon treatment (by spectrophotometer—LICO 400) | +0 | +16 |
| JFTOT (275° C.) | Fail | Pass |
| Tube rating | >4P | <3 |
| Pressure drop (mm Hg) | 25 (40 min) | 0 |

Example 7

Table 7 below shows that nitrogen and color do not necessarily correlate with thermal stability. In this Example, the treated jet fuel was in contact with PolyMax® 845 for about 24 hours in a shaker under an inert (nitrogen gas) atmosphere at room temperature (about 20° C. to about 25° C.). Catalyst particle sizes of less than ~0.42 mm were used. It can be seen that even with a substantial decrease in nitrogen concentration, the treated jet fuel failed JFTOT with a tube rating of 4P. The JFTOT specifications for jet fuel include a tube rating of <3 (without peacock or abnormal color deposits) and a maximum pressure drop of ~25 mm Hg within the ~3-hour test. Similarly, even though the treated jet fuel was on ~spec for color (Saybolt color≥12), it failed JFTOT.

TABLE 7

| treat (g per 45 ml) | Untreated jet 0 | Treated jet 0.02 |
|---|---|---|
| nitrogen (mg/l) | 11.2 | 3.7 |
| color (LICO 400 spectrophotometer) | +5 | +17 |
| color (Saybolt) | — | +15 |
| JFTOT (275° C.) | — | fail |
| tube rating | | 4P |
| pressure drop (mm Hg) | | 0 |

Example 8

Table 8 below shows that a significant portion of the nitrogen removed upon contact with PolyMax® 845 can qualify as basic nitrogen (as determined by potentiometric titration). Table 8 further shows that trends regarding total nitrogen content can qualitatively track trends regarding basic nitrogen content. In this Example, the treated jet fuel was in contact with the solid phosphoric acid for about 24 hours in a shaker under an inert (nitrogen gas) atmosphere at about 60° C. Catalyst particle sizes of less than ~0.42 mm were used.

TABLE 8

| | Treated jet | | |
|---|---|---|---|
| treat (g per 45 ml) | 0 | 0.02 | 0.03 |
| total nitrogen (mg/l) | 10.6 | 4.3 | 2.5 |
| basic nitrogen (wppm) | 11.0 | 2.9 | 1.8 |
| color improvement upon treatment (by spectrophotometer—LICO 400) | +0 | +6 | +8 |

Example 9

PolyMax® 845 was used in a (semi-) continuous unit at room temperature (about 20° C. to about 25° C.). A column with a length of about 18 inches and an inner diameter of about 0.65 inches was used in an upflow configuration. The flowrate was set to ~3 ml/min with a superficial velocity of about 0.34 USgpm/ft$^2$ and a liquid hourly space velocity of ~2.3 hr$^{-1}$, based on the volume of catalyst loaded. The feed was jet fuel that had been processed in a commercial Merox™ reactor, water washed, as salt dried. Properties of the treated jet fuel were determined at several intervals, e.g., when varying amounts of jet fuel had been treated by the solid phosphoric acid catalyst loaded in the column. PolyMax® 845 with sizes between about 0.25 mm and about 1.19 mm was used. Table 9 shows the results.

TABLE 9

| cumulative life (bbl/lb) | 0.01 | 0.15 | 0.78 | 0.92 | 1.07 | 1.22 | 1.67 | 1.98 | 2.13 |
|---|---|---|---|---|---|---|---|---|---|
| feed color (Saybolt) | −7 | −7 | −7 | −7 | −7 | −7 | −7 | −7 | −7 |
| product color (Saybolt) | +29 | +23 | +18 | +18 | +18 | +18 | +17 | +17 | +14 |
| Nitrogen (mg/l) | — | — | — | — | — | — | — | <1.0 | <1.0 |
| JFTOT (275° C.) | pass | pass | pass | pass | pass | pass | pass | pass | fail |
| tube rating | 1 | 1 | 2 | 2 | 2 | 2 | <3 | <3 | <3A |
| pressure drop (mm Hg) | 0 | 0 | 0 | 0 | 0 | 0 | 0 | 0 | 0 |

Example 9 demonstrates that a contact time of about 26.3 minutes between jet fuel and solid phosphoric acid catalyst was sufficient to meet the JFTOT specification in a continuous unit, even with relatively low superficial velocities. Higher superficial velocities, as found in certain typical commercial units, would be expected to improve the performance, e.g., by minimizing external mass transfer effects. PolyMax® 845 in this Example, with sizes between about 0.25 mm and about 1.19 mm, exhibited a packing density of approximately 1 g/ml.

The amount of PolyMax® 845 with sizes between about 0.25 mm and about 1.19 mm required for the jet fuel to meet the JFTOT specification upon contact in the (semi-) continuous unit can be calculated as follows:

$$\text{catalyst mass[g]}=\text{catalyst volume[ml]}\times\text{catalyst packing density[g/ml]} \quad (1)$$

Equation (1) can be rewritten as:

$$\text{catalyst mass[g]}=\text{residence time[min]}\times\text{feed flowrate [ml/min]}\times\text{catalyst packing density[g/ml]} \quad (2)$$

Using the packing density of PolyMax® 845 (sizes between about 0.25 mm and about 1.19 mm), and considering that a residence time of about 26.3 minutes was sufficient to meet the JFTOT specification, equation (2) becomes:

$$\text{catalyst mass[g]}\approx 26.3\ \text{[min]}\times\text{feed flowrate[ml/min]}\times 1\ \text{[g/ml]} \quad (3)$$

Hence, the amount of PolyMax® 845 with sizes between about 0.25 mm and about 1.19 mm required to meet the JFTOT specification in a continuous unit is given by:

$$\text{catalyst mass[g]}\approx 26.3\times\text{feed flowrate[ml/min]} \quad (4)$$

Shorter residence times can be expected to meet the JFTOT specification, assuming certain variations in feed quality, superficial velocity, catalyst particle sizes, and operating temperature. Similarly, longer residence times may be required to meet the JFTOT specification, assuming different variations in feed quality, superficial velocity, catalyst particle sizes, and operating temperature. Expressed in another way, it is expected that, when contact between catalyst and flowing feedstock is carried out in a contact zone at a ratio of catalyst mass within the zone to a mass flow rate of feedstock through the zone of at least about 18 minutes, substantial improvement in JFTOT and/or fuel thermal stability can result. The above Examples further show that improvement of fuel quality by reduction in nitrogen content or enhancement in color quality are not necessarily indicative of substantial improvement in fuel thermal stability and/or of passing JFTOT.

The principles and modes of operation of this invention have been described above with reference to various exemplary and preferred embodiments. As understood by those of skill in the art, the overall invention, as defined by the claims, encompasses other preferred embodiments not specifically enumerated herein.

What is claimed is:

1. A method for increasing thermal stability of fuel, comprising:

flowing a jet fuel feedstock through a contact zone containing solid phosphoric acid catalyst within the contact zone, wherein the jet fuel feedstock has an initial and final boiling point within a range from about 90° C. to about 360° C. (194° F. to about 680° F.), and wherein the jet fuel feedstock is in contact with the solid phosphoric acid catalyst for a period of time of at least about 18 minutes; and producing a fuel product that has a higher thermal stability than the fuel feedstock according to ASTM D3241-09.

2. The method of claim 1, wherein the solid phosphoric acid catalyst is comprised of silicon orthophosphate.

3. The method of claim 2, wherein the solid phosphoric acid catalyst is further comprised of silicon pyrophosphate and exhibits an integrated X-ray diffraction (XRD) reflectance peak intensity ratio of silicon orthophosphate to silicon pyrophosphate of at least about 4:1.

4. The method of claim 2, wherein the solid phosphoric acid catalyst has a silicon phosphate crystallinity of at least 25% relative to an alpha-alumina standard.

5. The method of claim 1, wherein the solid phosphoric acid catalyst is comprised of pyrophosphate crystallites with at least 0.1% crystallinity (as measured by X-ray diffraction) relative to alpha-alumina.

6. The method of claim 1, wherein the solid phosphoric acid catalyst as a pore volume of at least about 0.01 $cm^3$ per gram of catalyst.

7. The method of claim 1, wherein the solid phosphoric acid catalyst has an average pore diameter of at least about 150 angstroms.

8. The method of claim 1, wherein the solid phosphoric acid catalyst has an average particle size of not greater than about 1.5 mm.

9. The method of claim 1, wherein the fuel feedstock is treated with a caustic composition prior to contacting with the solid phosphoric acid catalyst,

10. The method of claim 9, wherein the fuel feedstock is treated with a mercaptan oxidation catalyst prior to contacting with the solid phosphoric acid catalyst.

11. The method of claim 10, wherein the fuel feedstock that is treated with the mercaptan oxidation catalyst is water washed prior to contacting with the solid phosphoric acid catalyst.

12. The method of claim 1, wherein the fuel feedstock is treated with a caustic composition in the presence of a mercaptan oxidation catalyst to produce a mercaptan-reduced product, and the mercaptan-reduced product is contacted with the solid phosphoric acid catalyst.

13. The method of claim 1, wherein the fuel feedstock has an ASTM D86 10% boiling point in a range from about 110° C. to 190° C. (230° F. to 374° F.), and an ASTM D86 90% boiling point in a range from about 200° C. to about 290° C. (392° F. to 554° F.).

14. The method of claim 13, wherein the fuel feedstock has a pressure drop of at least 20 mmHg per ASTM D3241-09 and the fuel product has a pressure drop less than 12mmHg.

15. The method of claim 13, wherein the fuel product has an increase in color quality by a differential color measurement of at least about 2 according to ASTM D156-07*a*relative to the fuel feedstock.

16. The method of claim 15, wherein the fuel feedstock has a color quality measurement of at least about 22 and the fuel product has a color quality measurement of about 18 or less according to ASTM D156-07*a*.

17. The method of claim 13, wherein the fuel product has a total nitrogen content of at least about 10% less than the total nitrogen content of the fuel feedstock.

18. The method of claim 17, wherein the fuel feedstock has a total nitrogen content of at least about 12 mg/1 and the fuel product has a total nitrogen content of about 10mg/1 or less.

19. The method of claim 1, wherein the fuel feedstock is treated with the solid phosphoric acid catalyst within the contact zone at a temperature in a range from about 10° C. to about 100° C. (50° F. to 212° F.).

20. The method of claim 19, wherein the fuel feedstock is treated with the solid phosphoric acid catalyst within the contact zone at a pressure from about 1 atm to about 10 atm (about 100 kPaa to about 1.0 MPaa).

21. The method of claim 20, wherein the liquid hourly space velocity (LHSV) of the fuel feedstock through the solid phosphoric acid catalyst in the contact zone is about 0.1 $hr^{-1}$ to about 10 $hr^{-1}$.

* * * * *